US005876828A

United States Patent [19]

Prosser

[11] Patent Number: 5,876,828

[45] Date of Patent: Mar. 2, 1999

[54] BLANK FOR DECORATOR'S TOOL

[76] Inventor: Edward Charles Prosser, The Boughs Cae Mawn RD Forth Mid, Giamorcan, United Kingdom, CF 39 9 BY

[21] Appl. No.: 793,827

[22] PCT Filed: Aug. 24, 1995

[86] PCT No.: PCT/GB95/02018

§ 371 Date: Apr. 10, 1997

§ 102(e) Date: Apr. 10, 1997

[87] PCT Pub. No.: WO96/05971

PCT Pub. Date: Feb. 29, 1996

[30] Foreign Application Priority Data

Aug. 25, 1994 [GB] United Kingdom ..... 94/7186

[51] Int. Cl.[6] ..... B44F 9/02

[52] U.S. Cl. ..... 428/99; 15/166; 15/210.5; 101/3.1; 101/23; 144/362; 428/106; 428/131; 428/161; 428/163; 428/167; 428/192

[58] Field of Search ..... 428/99, 106, 131, 428/161, 163, 167, 192; 15/210.5, 166; 101/3.1, 23; 144/362

[56] References Cited

U.S. PATENT DOCUMENTS

| | | | |
|---|---|---|---|
| 960,821 | 6/1910 | Clapp | 15/210.5 |
| 3,843,992 | 10/1974 | Briggs | 15/210.5 |
| 5,507,064 | 4/1996 | King | 15/210.5 |

FOREIGN PATENT DOCUMENTS

| | | |
|---|---|---|
| 0406514 | 1/1991 | European Pat. Off. . |
| 9313771 | 12/1993 | European Pat. Off. . |
| 2599412 | 12/1987 | France . |
| 9416910 | 8/1994 | WIPO . |

*Primary Examiner*—Nasser Ahmad
*Attorney, Agent, or Firm*—Edwin D. Schindler

[57] ABSTRACT

The decorator's graining tool (1) is formed from a flat blank (8), which can be wrapped around and secured to itself so as to form the tool in the form of a tubular body having a plurality of teeth (2) at one end and an arcuate convex face (3) at the other end, the convex face forming the outer surface of the tubular body and having a plurality of spaced ridge formations thereon (4). The ridge formations (4) may comprise either a series of undulating ridges (5) and furrows (6), or, alternatively, smooth ridges and furrows in which the formations (4) are concentric about an intermediate point (7) of the convex face (3).

17 Claims, 5 Drawing Sheets

BLANK FOR DECORATOR'S TOOL

BACKGROUND OF THE INVENTION

The present invention relates to a blank for a decorator's tool and, in particular, to blank for a tool for applying an imitation woodgrain finish to a surface.

It is known to create imitation woodgrains on a surface using specialised tools to create the grain finish. Normally, at least two tools are required in order to achieve the desired effect. Existing tools consist of combs having teeth or the like which are used to establish a continuous streaked or grained appearance on a painted substrate, and a separate tool having a convex surface, with a series of concentric ridge formations on the convex surface, which can be used to selectively expose parts of the surface, so as to produce a simulated natural woodgrain appearance on the surface. Using separate tools to create the woodgrain finish suffers from a number of drawbacks. In particular, it is necessary to frequently interchange the tools, which is time consuming and often leads to an inconsistent finish. Frequently, the tools are purchased as a set, and subsequently, if one is misplaced, it is necessary to replace both tools, by purchasing a complete set. In addition, packaging of two separate tools in a box or the like requires extra packaging space and packaging material, which adds to the total cost of the product.

SUMMARY OF THE INVENTION

It is the purpose of the present invention to alleviate such problems and to provide a blank for a unitary, hand-holdable tool, suitable for use by decorators in creating an imitation woodgrained finish on a surface.

According to one aspect of the invention, there is, therefore provided a blank for forming a decorator's tool, which blank can be wrapped around and secured to itself by securing means to form said tool, such that said tool comprises at one end thereof a hollow body having a convex surface with a plurality of spaced-apart proud formations (i.e., a plurality of spaced-apart ribs) on the convex surface and a plurality of teeth formations at the other end of said tool. Thus, advantageously, both working surfaces needed to create the desired effect are provided in a single hand-held portable unit, which can be formed from an easily storable blank, and either end may be held, as appropriate, when the tool is used to create the grained appearance.

The proud formations on the convex surface may comprise a series of substantially concentric formations. Advantageously, the concentric formations comprise a series of alternating ridges and furrows concentric about a substantially intermediate point on the convex surface of the tool. The tool can be rocked about the convex surface to complete a simulated natural woodgrained finish created by the concentric ridges and furrows. Alternatively, the proud formations may be more irregular, or may comprise a series of spaced ridges in the form of straight or wavy lines. It may be desirable to provide gaps in such lines at spaced intervals (that is, the lines may be discontinuous).

Preferably, a plurality of apertures are positioned within the alternating ridges and furrows on the convex surface of the tool. Thus, a build-up of excess woodgraining material within the furrows may be substantially alleviated as the material can pass into the interior of the tubular body of the tool, thus facilitating cleaning of the tool and collection of the excess material when such material has passed through the apertures on the convex surface, to the inside of the hollow body of the tool, during the woodgraining process.

In one embodiment of the invention, the teeth formations may be on a separate attachment which can be secured to the tool. The teeth formations on the separate attachment may also function as the securing means of the tool which advantageously fits over the ends of the blank when wrapped around itself to form the tool. In another embodiment, the teeth formations may be on one or both ends of the blank which forms the tool. Where the teeth are on both ends of the blank, two sets of teeth formations may be provided which advantageously may be orientated in substantially opposite directions on the tool.

Advantageously, the distance between each of the teeth corresponds substantially to the distance between each of the proud formations situated on the convex surface. Thus, when the teeth have been used to produce a veined appearance on the surface, the ridges on the convex surface, when rocked about the convex surface, complete the continuous natural grained finish. Typically, the tips of the teeth comprise a contact edge extending for about 2–5 mm on each side of the teeth. Thus, advantageously, either side of the teeth can be used in either direction, eliminating confusion as to which side of the tool is to be used. Typically, the teeth and ridge formations are between 2–10 mm apart.

In a preferred embodiment, the teeth formations, the convex surface and the proud formations all together comprise a unitary integral moulding.

In another embodiment, the proud formations may be on a separate moulding attachment, releasably engageable with the blank which comprises the base of the tool. This would allow imitation woodgrains of different size and shape to be created by the same tool.

Typically, the securing means comprise complementary jointing formations such as a dovetail joint, or pop studs releasably engageable with reception apertures on the blank. In the latter case, further reception apertures may be provided in series along the length of the blank to receive such pop studs, serving to maintain the blank in its proper configuration. Alternative securing means comprise adhesive (for example double-sided adhesive tape). Thus, advantageously, the diameter of the convex surface of the tool may be varied, thus creating grains of different size and shape.

Connection means may also be provided to connect the mould attachment to the tool; the connection means may comprise pop studs releasably engageable with reception apertures of the type as described for maintaining the blank in the tool configuration.

The blank may be made of any suitably stiff material, but which is sufficiently flexible to allow the blank to be wrapped around, or doubled over on itself, without snapping. The material used for the blank may comprise a suitable plastics material, which is sufficiently flexible and lightweight, and thus easily portable.

In one embodiment of the invention, the blank is substantially flat, and may have a plurality of fold lines along its length such that when the blank is wrapped around itself along the fold lines it forms the tool. Alternatively, the blank may be stepped in cross section.

BRIEF DESCRIPTION OF THE DRAWINGS

The invention may be more clearly understood from the following description of an embodiment thereof, by way of example only, with reference to the accompanying drawings, in which.

DETAIL DESCRIPTION OF THE EMBODIMENTS

Figure 1:
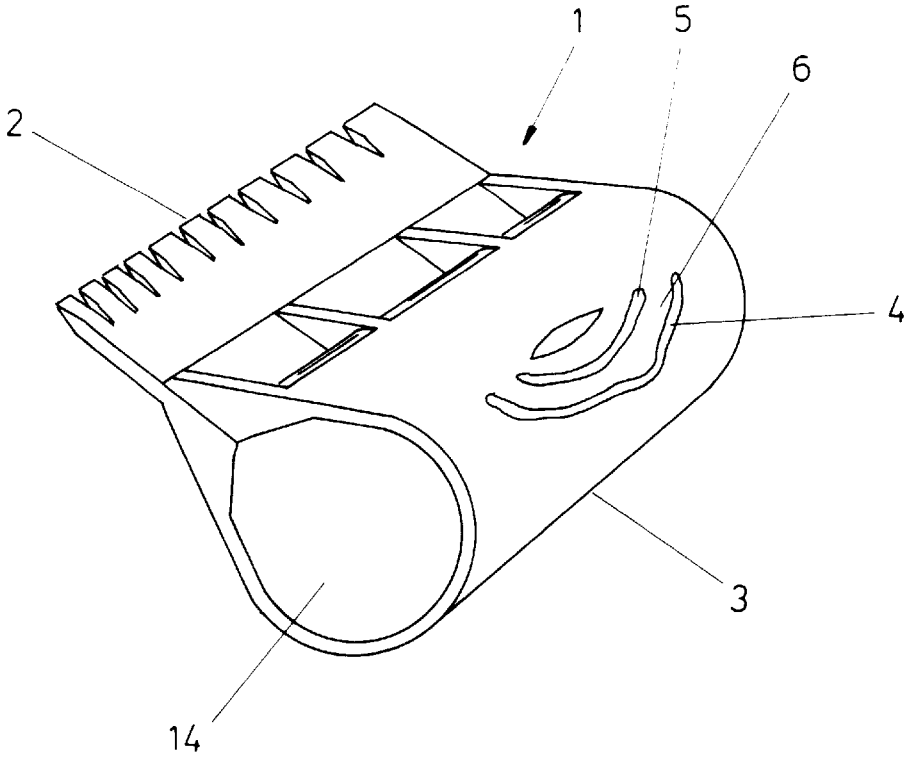
FIG. 1 is a perspective view of a tool made from a blank according to the invention.
Figure 2:
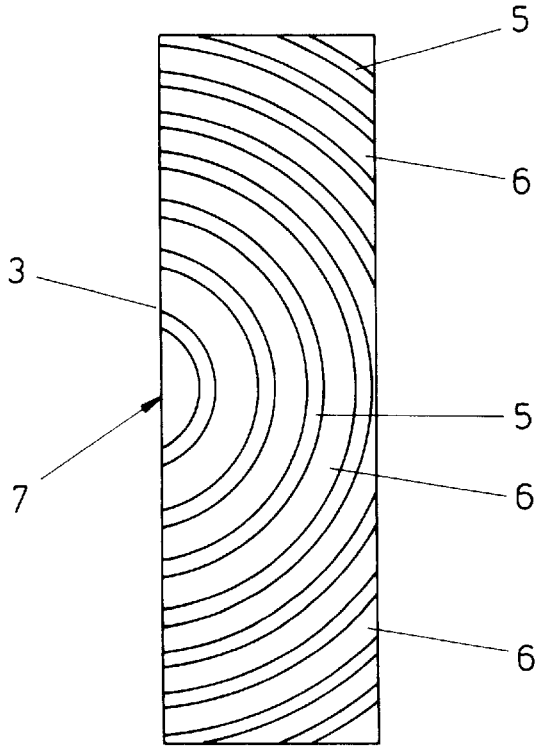
FIG. 2 is an elevational view of an alternative convex surface for the blank of FIG. 1.

Referring initially to FIG. 1, there is shown a graining tool for use by decorators, which tool is indicated generally by the reference numeral 1. The tool comprises a plurality of teeth 2, and an arcuate convex surface 3, having a plurality of spaced ridge formations 4 which comprise a series of undulating ridges 5 and furrows 6. (An alternative arrangement with smooth ridges and furrows is illustrated in FIG. 2, in which the formations 4 are concentric about an intermediate point 7 of the convex surface 3 of the tool.) The tool 1 is substantially pear-shaped in cross-section. The end of the tool having the convex surface 3 is hollow.

Figure 3:
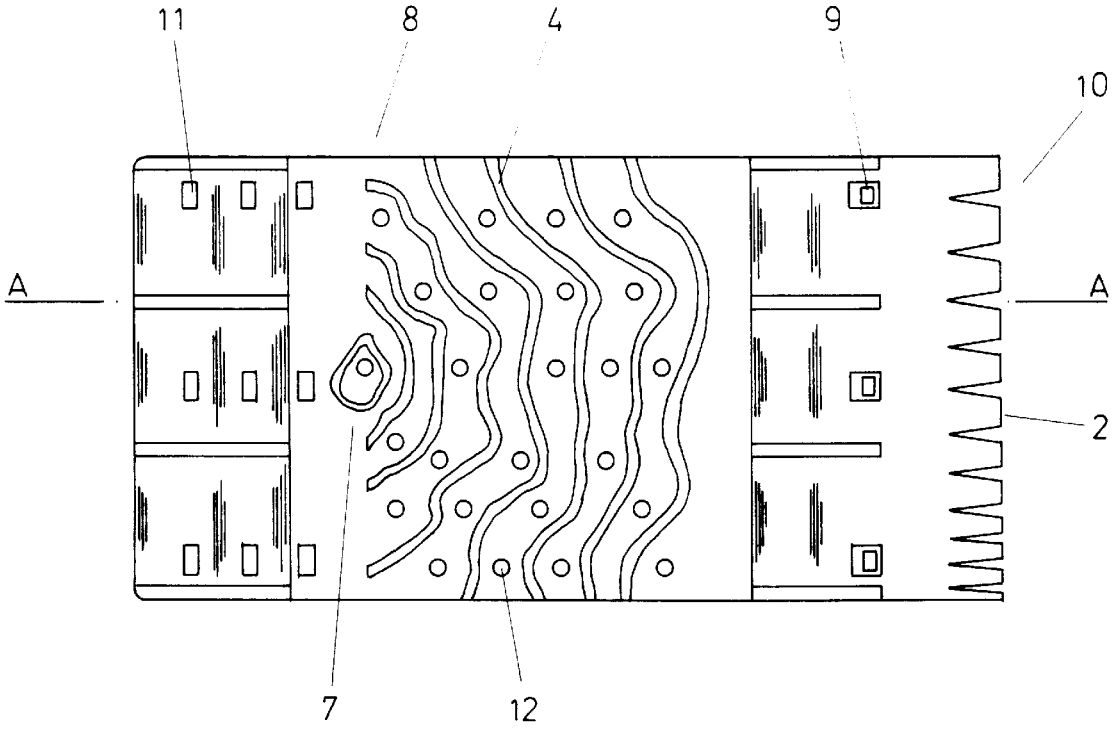
FIG. 3 is a plan view of a flat blank according to the invention.
Figure 4:
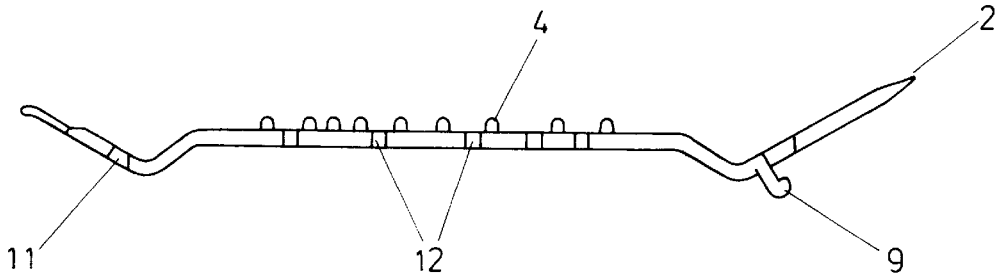
FIG. 4 is a section along the line A—A of FIG. 3.
Figure 5:
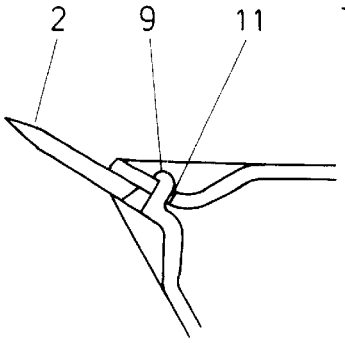
FIG. 5 is a detailed sectional view of the connected ends of the assembled tool of FIG. 1.

Referring to FIGS. 3 to 5, there is illustrated a blank 8, which forms the graining tool 1. The blank 8 is folded over and secured to itself such that the ridge formations 4 are on the outer convex surface of the tool 1. Studs 9 are provided on an end 10 of the blank 8, for engaging with reception apertures 11 on the opposite end of the blank 8. A further series of apertures 12 is interspaced between the furrows 6 of the outer convex surface of the tool 1, the apertures serving to alleviate build-up of excess graining material (not shown) during the graining process, the excess graining material passing through the apertures 12 into the space 14 (shown in FIG. 1) which is formed when the blank 8 is folded over upon itself to form the tool 1.

Figure 6:
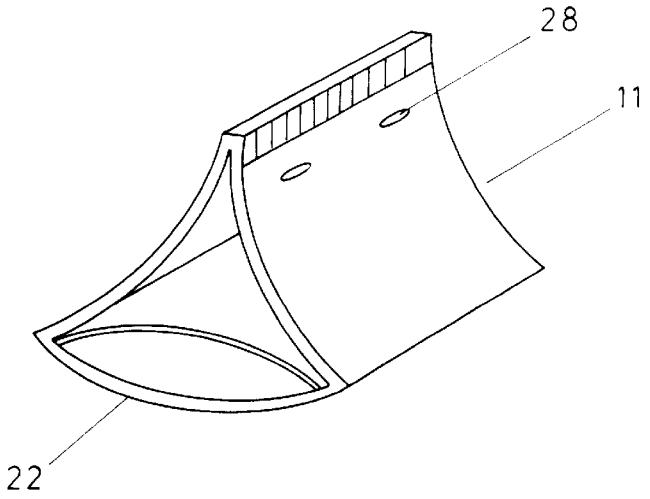
FIG. 6 is a perspective view of a further embodiment of tool formed from a blank according to the invention.
Figure 7:
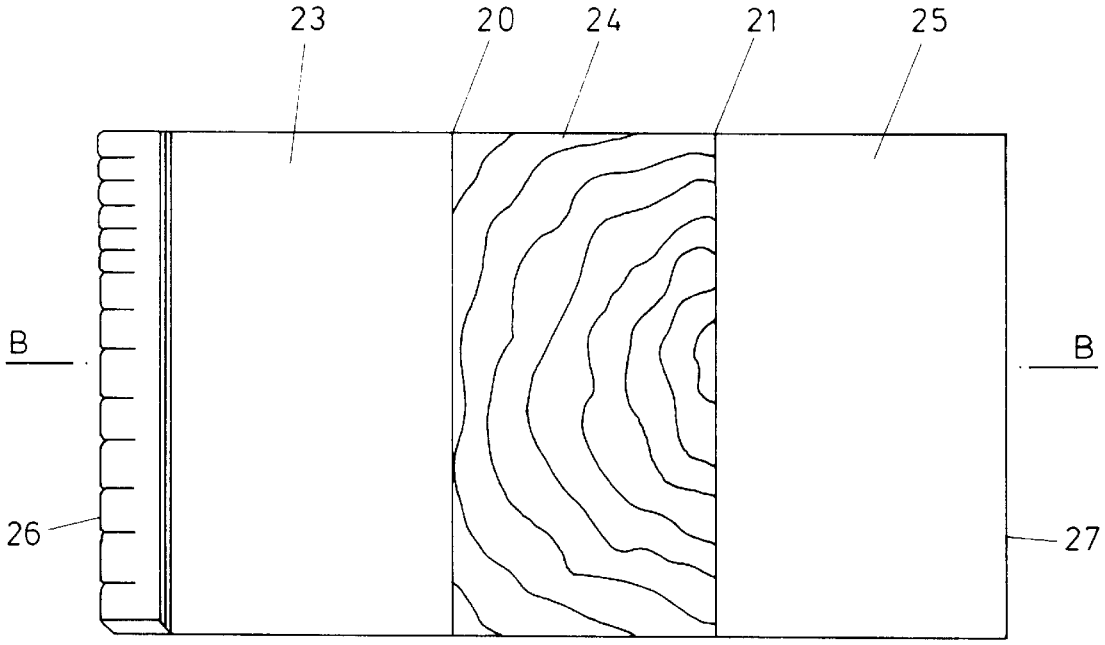
FIG. 7 is a plan view of a blank which forms the tool of FIG. 6.
Figure 8:
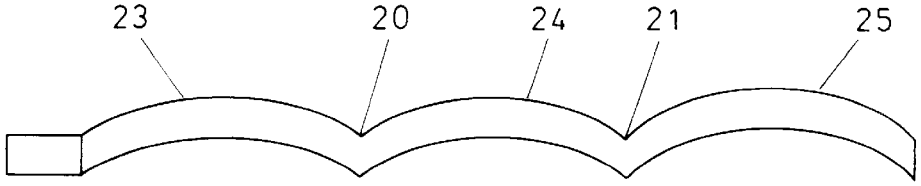
FIG. 8 is a section along the line B—B of FIG. 7.

Referring to FIGS. 6 to 8, and initially to FIG. 6, there is illustrated an alternative embodiment of a graining tool 11. The blank 8 which forms the tool (as shown in FIGS. 7 and 8) comprises fold lines 20 and 21 spaced along the length of the blank. Fold line 20 separates concave surfaces 23 and 24, and fold line 21 separates concave surfaces 24 and 25. When surfaces 23 and 25 are folded about their respective fold lines 20 and 21, the ends 26 and 27 are brought together to form the tool 11. When the tool 11 is formed, the concave surface 24 can be pushed outwardly to form the convex surface 22 of the tool 11. The ends 26 and 27 can be secured by pop studs (not shown) on one end of the tool engaging with complementary apertures on the other end in the same way as for the embodiment of FIG. 1 described above. Alternatively, the ends can be secured by a separate attachment (not shown), which fits over the ends 26 and 27 of the tool. The separate attachment 30 provides the teeth formations 31.

Figure 9:
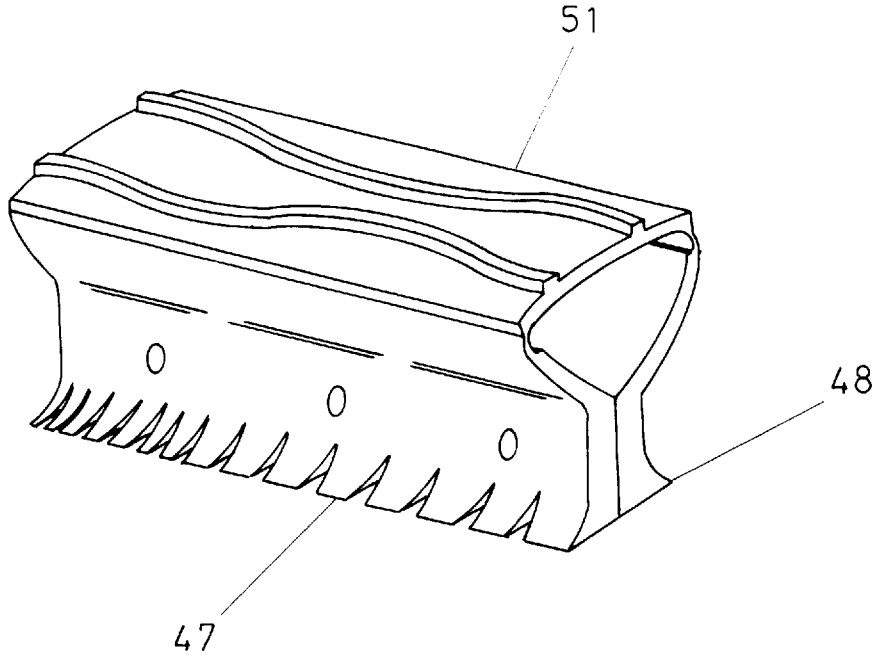
FIG. 9 is a perspective view of an alternative embodiment of tool formed from a blank according to the invention.
Figure 10:
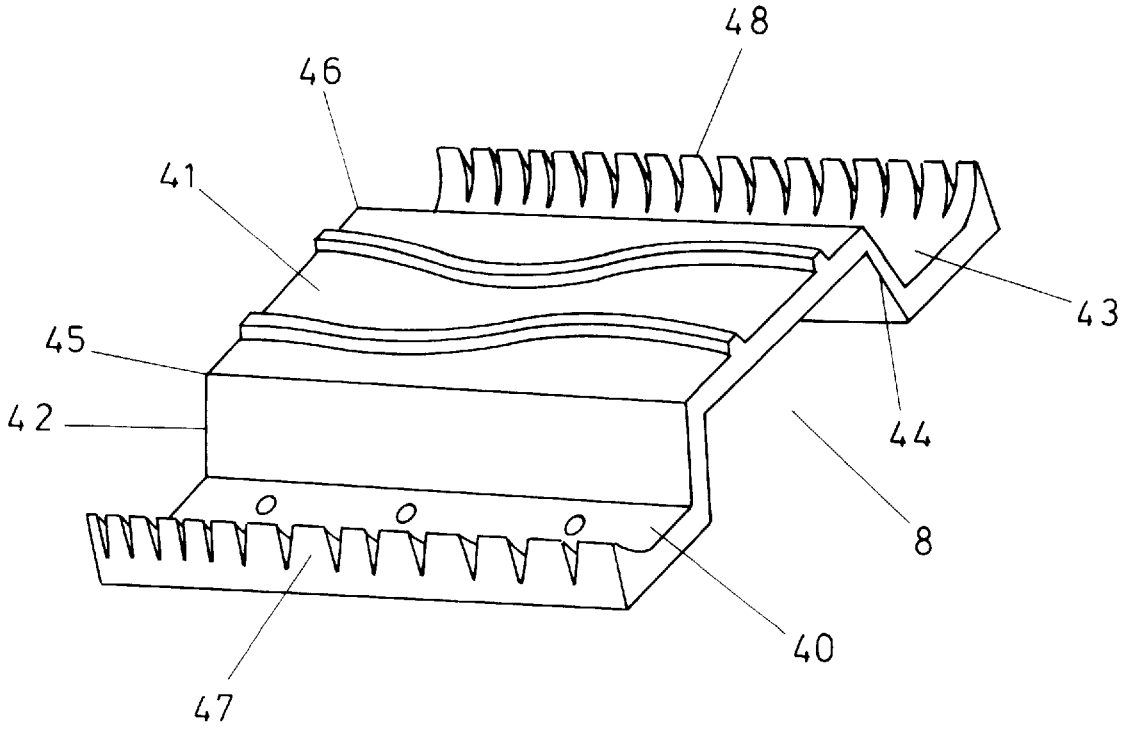
FIG. 10 is a perspective view of a blank which can form the tool shown in FIG. 9.
Figure 11:
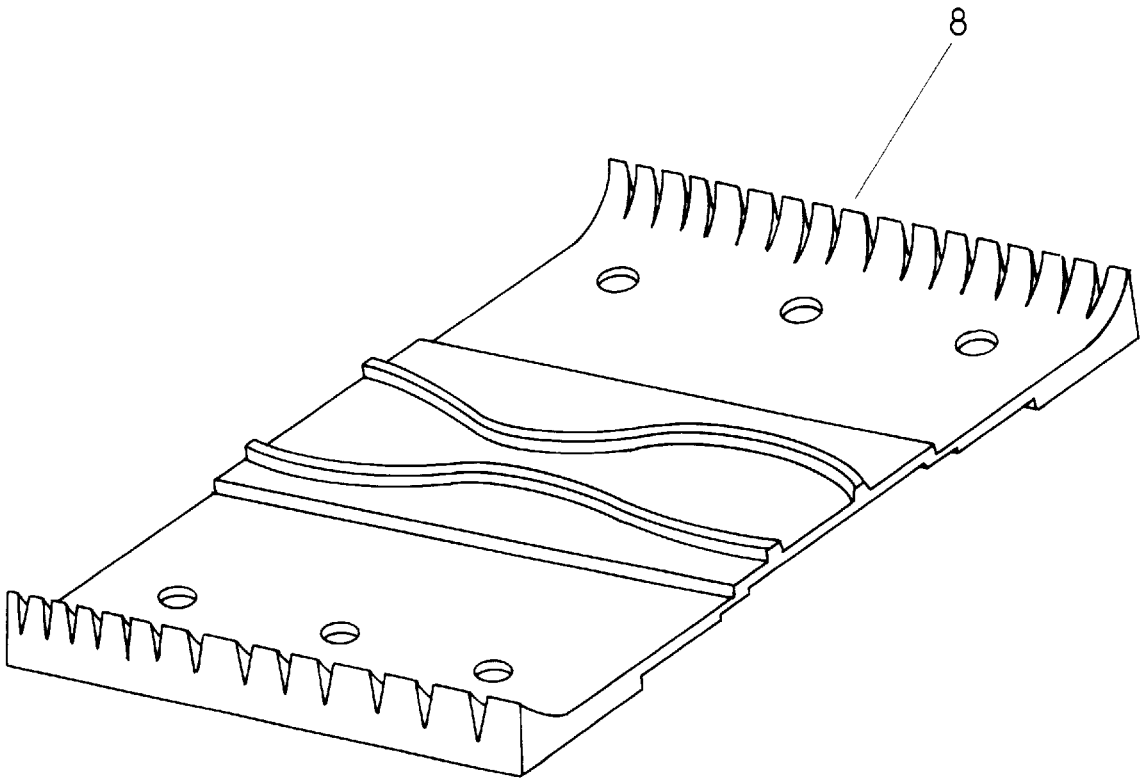
FIG. 11 is a perspective view of an alternative blank which can form the tool shown in FIG. 9.

Referring to FIGS. 9 to 11, there is illustrated a further embodiment of the graining tool 51. The blank 8 which forms the tool is shown in FIGS. 10 and 11. The blank 8 in FIG. 10 is stepped, having a surface 40 connected to a stepped surface 41 by a first intermediate web 42. The stepped surface 41 is connected to a further surface 43 by a second intermediate web member 44. Teeth formations 47 and 48 are oriented substantially upwardly with respect to the surfaces 40 and 43 respectively. The blank is folded about fold lines 45 and 46 on the stepped surface to form the tool 51, the teeth formations 47 and 48 being oriented on the tool 51 in substantially opposite directions. The surfaces 40 and 43 are secured to one another by complementary engaging formations, such as a dovetail joint (not shown) or alternatively by adhesive tape or the like. The blank 8 shown in FIG. 11 forms the same tool 51 but is substantially flat in cross section.

The invention is not limited to the embodiment hereinbefore described but may be varied in both construction and detail.

I claim:

1. A blank for forming a decorator's tool, comprising:

(a) a body member comprised of a flexible sheet having a first, flat configuration and a second, rolled configuration providing a hollow body, said flexible sheet being transformable from said first, flat configuration to said second, rolled configuration by a rolling action, said body member including:

(i) a first face being an outer face when said flexible sheet is in said second, rolled configuration, and, (ii) a second face being an inner face when said flexible sheet is in said second, rolled configuration;

(b) a plurality of spaced-apart ribs being provided on said first face, wherein said hollow body has said plurality of spaced-apart ribs on an outer, convex surface of said hollow body;

(c) a plurality of teeth formations provided at a first end of said body member; and, (d) complementary reception means provided at a second end of said body member, said complementary reception means being engageable with said plurality of teeth formations.

2. The blank for forming a decorator's tool according to claim 1, wherein said plurality of spaced-apart ribs comprise a series of substantially concentric formations.

3. The blank for forming a decorator's tool according to claim 2, wherein said substantially concentric formations comprise a series of alternating ridges and furrows concentric about a substantially intermediate point on the convex surface of said body member.

4. The blank for forming a decorator's tool according to claim 2, wherein said plurality of spaced-apart ribs comprise a series of spaced-apart alternating ridges and furrows, said ridges being in the form of wavy lines.

5. The blank for forming a decorator's tool according to claim 4, wherein said wavy lines are discontinuous.

6. The blank for forming a decorator's tool according to claim 4, wherein said series of spaced-apart alternating ridges and furrows are on said convex surface and include a plurality of apertures within said ridges and furrows.

7. The blank for forming a decorator's tool according to claim 1, wherein said plurality of teeth formations is on a separate attachment and is secured to said body member.

8. The blank for forming a decorator's tool according to claim 7, wherein said separate attachment having said plurality of teeth formations comprises securing means.

9. The blank for forming a decorator's tool according to claim 1, wherein the distance between individual teeth of said plurality of teeth formations is substantially equal to the distance between successive said spaced-apart ribs on said convex surface of said body member.

10. The blank for forming a decorator's tool according to claim 9, wherein said individual teeth and said spaced-apart ribs are 2 to 10 mm apart.

11. The blank for forming a decorator's tool according to claim 9, wherein said individual teeth have tips comprising a contact edge extending for 2 to 5 mm on each side of said individual teeth.

12. The blank for forming a decorator's tool according to claim 1, wherein said plurality of teeth formations, said convex surface of said body member and said plurality of spaced-apart ribs all together comprise a unitary integral molding.

13. The blank for forming a decorator's tool according to claim 1, wherein said plurality of spaced-apart ribs are on a separate molding, releasably engaged with said hollow body.

14. The blank for forming a decorator's tool according to claim 13, further comprising attachment means for securing said molding to said decorator's tool.

15. The blank for forming a decorator's tool according to claim 14, wherein said attachment means comprise pop studs releasably engaged with reception apertures.

16. The blank for forming a decorator's tool according to claim 1, wherein said blank is substantially flat in cross-section and has a plurality of fold lines along its length, so that when said blank is wrapped around along said fold lines, said blank is able to form said decorator's tool.

17. The blank for forming a decorator's tool according to claim 1, wherein said blank is stepped in cross-section and has a plurality of fold lines, so that when said blank is wrapped around along said fold lines, said blank is able to form said decorator's tool.

* * * * *